US007677225B2

(12) United States Patent
Radue et al.

(10) Patent No.: US 7,677,225 B2
(45) Date of Patent: Mar. 16, 2010

(54) FUEL DELIVERY SYSTEM FOR ENGINE

(75) Inventors: Martin L. Radue, Plymouth, WI (US); William D. Koenigs, Fond du Lac, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 12/025,288

(22) Filed: Feb. 4, 2008

(65) Prior Publication Data

US 2009/0194074 A1 Aug. 6, 2009

(51) Int. Cl.
*F02M 37/04* (2006.01)

(52) U.S. Cl. ..... 123/509; 123/516

(58) Field of Classification Search ..... 123/509, 123/510, 511, 516, 457, 458
See application file for complete search history.

(56) References Cited

U.S. PATENT DOCUMENTS 4,539,965 A * 9/1985 Soltau ..... 123/514
4,579,093 A 4/1986 Eanes
4,844,043 A * 7/1989 Keller ..... 123/516
4,848,283 A * 7/1989 Garms et al. ..... 123/73 AD
5,103,793 A * 4/1992 Riese et al. ..... 123/516
5,368,001 A * 11/1994 Roche ..... 123/510
5,389,245 A * 2/1995 Jaeger et al. ..... 210/129
5,579,740 A 12/1996 Cotton et al.
5,647,331 A * 7/1997 Swanson ..... 123/516
5,855,197 A 1/1999 Kato
5,865,160 A * 2/1999 Kato ..... 123/516
5,873,347 A * 2/1999 Kato et al. ..... 123/497
5,908,020 A * 6/1999 Boutwell et al. ..... 123/541
6,216,671 B1 4/2001 Sawert et al.
6,257,208 B1 7/2001 Harvey
6,305,357 B1 10/2001 Soukeras
6,311,725 B1 * 11/2001 Hamada et al. ..... 137/565.13
6,314,946 B1 11/2001 Funakura et al.
6,345,608 B1 2/2002 Rembold et al.
6,405,711 B1 6/2002 Smith et al.
6,484,342 B2 11/2002 Takasaki et al.
6,655,366 B2 * 12/2003 Sakai ..... 123/518
6,679,229 B2 * 1/2004 Wada et al. ..... 123/516
6,718,953 B1 * 4/2004 Torgerud ..... 123/516
6,729,308 B1 * 5/2004 Kanamaru ..... 123/510
6,739,318 B2 * 5/2004 Nomura ..... 123/461
6,792,918 B1 * 9/2004 Halsall ..... 123/446
6,802,301 B2 * 10/2004 Fauser et al. ..... 123/509
6,866,029 B1 3/2005 Clarkson et al.
6,918,380 B2 7/2005 Nomura
6,971,374 B2 * 12/2005 Saito ..... 123/516

(Continued)

*Primary Examiner*—Thomas N Moulis
(74) *Attorney, Agent, or Firm*—Whyte Hirschboeck Dudek SC

(57) ABSTRACT

An integrated, modular system for delivering fuel to an engine component in an engine having a fuel tank, as well as engine employing such a system, and methods of implementing such a system, are disclosed herein. In at least one embodiment, the system includes a housing defining a chamber, an in inlet, and a passage leading to an outlet, the inlet receiving fuel from the tank and directing the fuel into the chamber, the outlet capable of providing fuel from the passage toward the engine component. The system also includes both a pump and a pressure regulator supported within the housing, with the pump having a pump input and output, and the pressure regulator having a regulator input and output. The pump input and regulator output are in communication with the chamber and the pump output and regulator input are in communication with the passage.

17 Claims, 4 Drawing Sheets

U.S. PATENT DOCUMENTS 7,114,491 B2 * 10/2006 Hamada et al. ..... 123/516
7,117,857 B2 * 10/2006 Saito et al. ..... 123/516
7,152,583 B2 12/2006 Abe et al.
7,168,414 B2 * 1/2007 Harvey ..... 123/509
7,503,314 B2 * 3/2009 Achor ..... 123/509
2002/0100457 A1 8/2002 Sakai
2004/0003796 A1 * 1/2004 Nomura ..... 123/461
2006/0048757 A1 3/2006 Harvey

* cited by examiner

FUEL DELIVERY SYSTEM FOR ENGINE

CROSS-REFERENCE TO RELATED APPLICATIONS

Not applicable

STATEMENT REGARDING FEDERALLY SPONSORED RESEARCH OR DEVELOPMENT

Not applicable

FIELD OF THE INVENTION

The present invention relates to internal combustion engines and, more particularly, to fuel supply components employed in internal combustion engines.

BACKGROUND OF THE INVENTION

In recent years, many engine manufacturers have developed and used turbine style fuel pumps to provide fuel to internal combustion engines. Turbine pumps have been preferred over more traditional fuel pumps employing gerotors or rolling vane components since turbine pumps generally are more efficient and less expensive to manufacture. However, since their inception turbine pumps have suffered from the limitation that, despite pushing fuel effectively out of the pump, they do not pull fuel into the pump very well. To overcome this weakness, turbine pumps are often placed within the fuel tanks from which they are drawing fuel, so as to reduce the force needed to pull fuel into the pumps. Placement of the pumps in the fuel tanks also reduces manufacturing costs since there is less concern over leakage from the pumps.

The use of in-tank turbine fuel pumps is an industry standard for automotive and power sports Electronic Fuel Injection (EFI) systems in particular. In-tank turbine fuel pumps are suitable for these industries because the engine manufacturers in these industries typically provide their own fuel tanks and fuel pumps that are specifically designed for use in conjunction with particular engines or vehicles. However, in-tank turbine fuel pumps are not particularly suitable in the area of small utility engines. Unlike manufacturers in the automotive and power sports industries, small utility engine manufacturers often try to utilize fuel systems that can be implemented universally on a wide variety of different types of engines and vehicles, and/or fuel systems that are applicable both to carbureted engines and to engines employing EFI systems. Indeed, it is typically desired that small utility engines be capable of universal (or largely universal) implementation in conjunction with a variety of vehicles and/or other applications. Yet the use of in-tank turbine fuel pumps in fuel tanks tends to limit the universality of application of those fuel systems with respect to different types of engines and vehicles.

Because of the restrictiveness of in-tank turbine fuel pumps in this regard, small utility engine manufacturers typically rely upon inline fuel pumps located outside of the fuel tanks instead of in-tank turbine fuel pumps. Yet although the use of in-line fuel pumps in conjunction with fuel tanks on small utility engines and associated vehicles enhances the universality of those fuel tanks/pumps with respect a variety of engines/vehicles, there are nevertheless certain other disadvantages associated with the use of in-line pumps in these applications. One disadvantage of using an in-line fuel pump is that it typically is only available with oversized flow capacity to produce the high-pressure necessary to pressurize an EFI system. This over-sizing typically results in a fuel flow that is three to eight times the flow capacity required. Also, the pressure of the fuel exiting the in-line fuel pump often may have a tendency to exceed the pressure required by the EFI system, and so there usually is a need to regulate the pressure of the fuel output by the fuel pump through the use of a pressure regulator.

The use of a pressure regulator in conjunction with the fuel tank and in-line fuel pump in turn complicates the design of the fuel delivery system. Not only must the fuel pressure regulator itself be mounted upon the engine/vehicle upon which the fuel delivery system is being implemented, but also a return fuel line must be provided to link the pressure regulator back to the fuel tank to allow for fuel exiting the regulator (as occurs when the pressure regulator determines that the output pressure of the fuel pump is excessive) to be returned to the fuel tank. Further, the implementation of the extra return fuel line necessitates the formation of an additional return hole in the OEM fuel tank wall. Modification of the fuel tank to in this manner can undermine any warranty provided by the OEM in relation to the fuel tank, and also can potentially decrease the useful life and reliability of the fuel tank.

The conventional arrangements of in-line fuel pumps in relation to small utility engines and associated vehicles are disadvantageous for additional reasons as well. For example, because such conventional arrangements tend to employ oversized in-line fuel pumps, operation of the pumps tends to consume relatively large amounts of power from the vehicle's electrical system. This is disadvantageous particularly in relation to small utility engines, which have limited battery recharging capabilities due to their size and power output. Further, conventional arrangements also are relatively incompatible with the process of upgrading a carbureted engine into an EFI engine. To upgrade an engine in this manner, the party performing the modification must perform multiple modifications to the engine so as to accommodate each of the electronic fuel pump, the pressure regulator and the return line back to the fuel tank.

For at least these reasons, therefore, it would be advantageous if an improved engine mounted fuel delivery system could be developed. More particularly, it would be advantageous if in at least some embodiments the improved engine mounted fuel delivery system could be more easily implemented in conjunction with a variety of types of engines and/or associated vehicles (or in conjunction with other applications), including engines/vehicles employing EFI systems. Additionally, it would be advantageous if in at least some embodiments the improved engine mounted fuel delivery system was particularly suitable for use in conjunction with small utility engines in that the fuel delivery system enhanced, or at least did not detract from, the universality of those engines with respect to different vehicle or other applications. Further, it would be advantageous if in at least some embodiments the improved engine mounted fuel delivery system could be easily implemented upon an engine that was previously a carbureted engine but was being modified to employ an EFI system. Additionally, in at least some embodiments, it would be advantageous if the demand imposed by such an improved engine mounted fuel delivery system upon an associated engine or vehicle's electrical system was reduced by comparison with conventional arrangements.

SUMMARY OF THE INVENTION

The present inventors have recognized the aforementioned disadvantages associated with conventional fuel system designs, and have further recognized that an improved engine mounted fuel delivery system can overcome one or more of these disadvantages by employing, in at least some embodiments, an integrated module including a subsidiary fuel tank separate from the main engine fuel tank and, additionally, a fuel pump and a pressure regulator housed within the module. The implementation of such an integrated module is less complicated than the implementation of conventional fuel delivery systems, both in terms of modifying a carbureted engine into an EFI engine and otherwise, insofar as only the single integrated module need be mounted upon the engine/vehicle, and insofar as no return line linking the pressure regulator with the main engine fuel tank is necessary since the fuel exiting the pressure regulator can be directly deposited into the subsidiary fuel tank. Given these considerations, such an integrated module is appropriate and applicable to a wide variety of engines and/or vehicles (or other applications) in which engines are employed, and is especially (but not exclusively) suitable for use in small utility engines that themselves are designed for largely universal use in a variety of vehicles (or other applications). Additionally, because the fuel pump is mounted within the integrated module, in at least some such embodiments, the fuel pump can take the form of a turbine fuel pump.

In at least some embodiments, the present invention relates to an integrated, modular system for delivering fuel to an engine component, the system configured for use with an engine that is suitable for a variety of different applications and that includes a fuel tank. The system includes a housing defining a reservoir chamber, an inlet, and an internal passage leading to an outlet, the inlet receiving fuel from the fuel tank and directing the received fuel into the reservoir chamber, the outlet capable of providing fuel from the internal passage toward the engine component. The system further includes a pump supported within the housing and having a pump input and a pump output, where the pump input is in fluid communication with the reservoir chamber and the pump output is in fluid communication with the internal passage. The system additionally includes a pressure regulator supported within the housing and having a regulator input and a regulator output, where the regulator input is in fluid communication with the internal passage and the regulator output is in fluid communication with the reservoir chamber. In at least some such embodiments, the integrated, modular system is capable of being implemented upon the engine by mounting the housing upon the engine, establishing a first connection between the inlet and the fuel tank, and establishing a second connection between the outlet and the engine component.

Additionally, in at least some embodiments, the present invention relates to an internal combustion engine suitable for use in conjunction with a plurality of applications. The internal combustion engine includes an Electronic Fuel Injection (EFI) engine intake system, a fuel tank, and a first pump coupled to receive fuel from the fuel tank. The engine further includes an integrated, modular fuel delivery system having a housing defining both a reservoir chamber and a supply passage therewithin, a second pump contained within the housing and coupled between the reservoir chamber and the supply passage, and a pressure regulator also contained within the housing and coupled between the reservoir chamber and the supply passage. The engine also includes first and second connectors respectively linking the first pump to an inlet of the reservoir chamber and linking an outlet of the supply passage to the EFI engine intake system, the inlet allowing for a first flow of the fuel from the first connector into the reservoir chamber, the outlet allowing for a second flow of pressurized fuel output by the second pump into the second connector.

Further, in at least some embodiments, the present invention relates to a method of providing pressurized fuel to an engine component, the method for use with an engine that is suitable for a variety of different applications and that includes a primary fuel tank. The method includes providing a housing defining a reservoir chamber and a supply passage having a discharge end, where an inlet tube for receiving fuel from the primary fuel tank extends through the housing and to the reservoir chamber. The method additionally includes providing a pump mechanism and a pressure regulator supported within the housing, where each of the pump mechanism and the pressure regulator is interconnected between the supply passage and the reservoir chamber. The method also includes pumping at least some of the fuel from the reservoir chamber to the supply passage by way of the pump mechanism, and regulating a pressure within the supply passage by way of the pressure regulator, which allows for at least some of the fuel pumped into the supply passage to pass back into the reservoir chamber when the pressure exceeds a threshold level. The method additionally includes discharging at least some of the fuel from the discharge end at least indirectly to the engine component.

Additionally, in at least some embodiments, the present invention relates to a method of converting an internal combustion engine from a first status in which the internal combustion engine is a carbureted engine to a second status in which the internal combustion engine employs an Electronic Fuel Injection (EFI) system. The method includes adding the EFI system to the internal combustion engine, and providing a fuel delivery system module having a housing that defines a reservoir chamber and a supply passage and that supports therewithin both a pump mechanism and a pressure regulator, the pump mechanism and the pressure regulator both linking the supply passage with the reservoir chamber. The method further includes connecting a primary fuel tank to an inlet of the fuel delivery system, the inlet leading to the reservoir chamber, and connecting an outlet of the supply passage to the EFI system.

DETAILED DESCRIPTION OF THE INVENTION

Figure 1A:
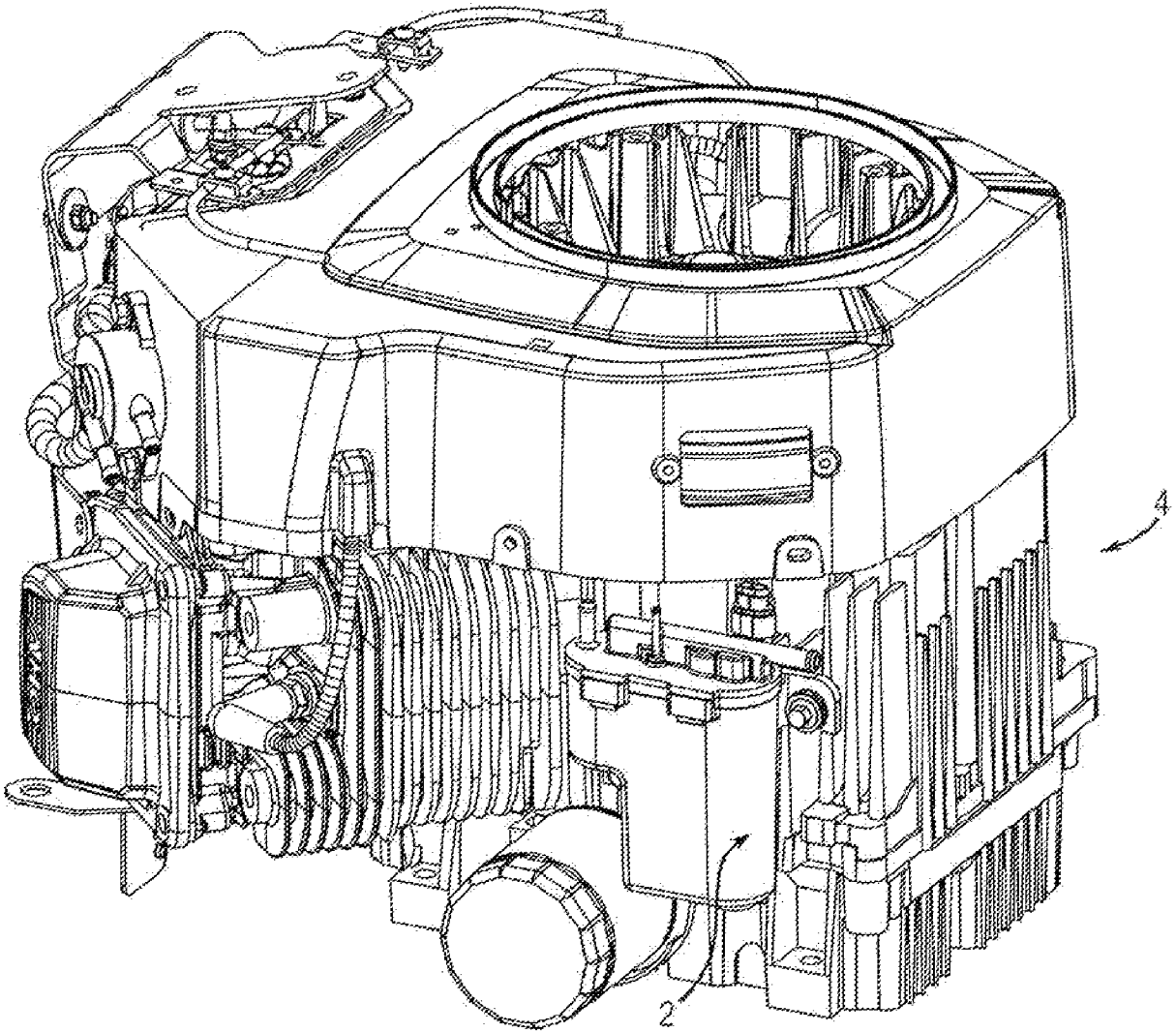
FIG. 1A is an exemplary perspective view of an improved engine mounted fuel delivery system as installed on an engine, in accordance with one embodiment of the present invention.

Referring to FIG. 1A, an improved engine mounted fuel delivery system (hereinafter referred to more simply as a "fuel delivery system") 2 in accordance with at least one embodiment of the present invention is shown to be installed on an engine 4. In the present embodiment, the engine 4 is a small utility internal combustion engine capable of being employed in a variety of applications including, for example, a variety of types of power machinery. For example, the engine 4 can be a Command Twin vertical-crankshaft internal combustion engine manufactured by Kohler Company of Kohler, Wis. Although not shown, it will be understood that in some cases the engine 4 can be employed in land vehicles such as lawn mowers, snow blowers, and other small vehicles such as utility vehicles. In alternate embodiments, it is also possible the fuel delivery system 2 of FIG. 1A or other embodiments of fuel delivery systems in accordance with the present invention will be implemented in conjunction with other types of engines (e.g., other than small utility engines) and/or in conjunction with other types of applications and/or vehicles.

In the present embodiment shown in FIG. 1A, it is envisioned that the fuel delivery system 2 will be installed onto the engine 4 by the engine's manufacturer. However, it is also envisioned that the fuel delivery system 2 can be sold as an after-market add-on product capable of being installed on an engine by a party other than the engine's manufacturer. Additionally, in at least the present embodiment, the fuel delivery system 2 is implemented in conjunction with, and to deliver pressurized fuel to, a typical Electronic Fuel Injection (EFI) system provided on the engine 4. Nevertheless, in alternate embodiments, the fuel delivery system 2 can be used with other types of engine components as well, and need not necessarily be utilized with an EFI system.

Figure 1B:
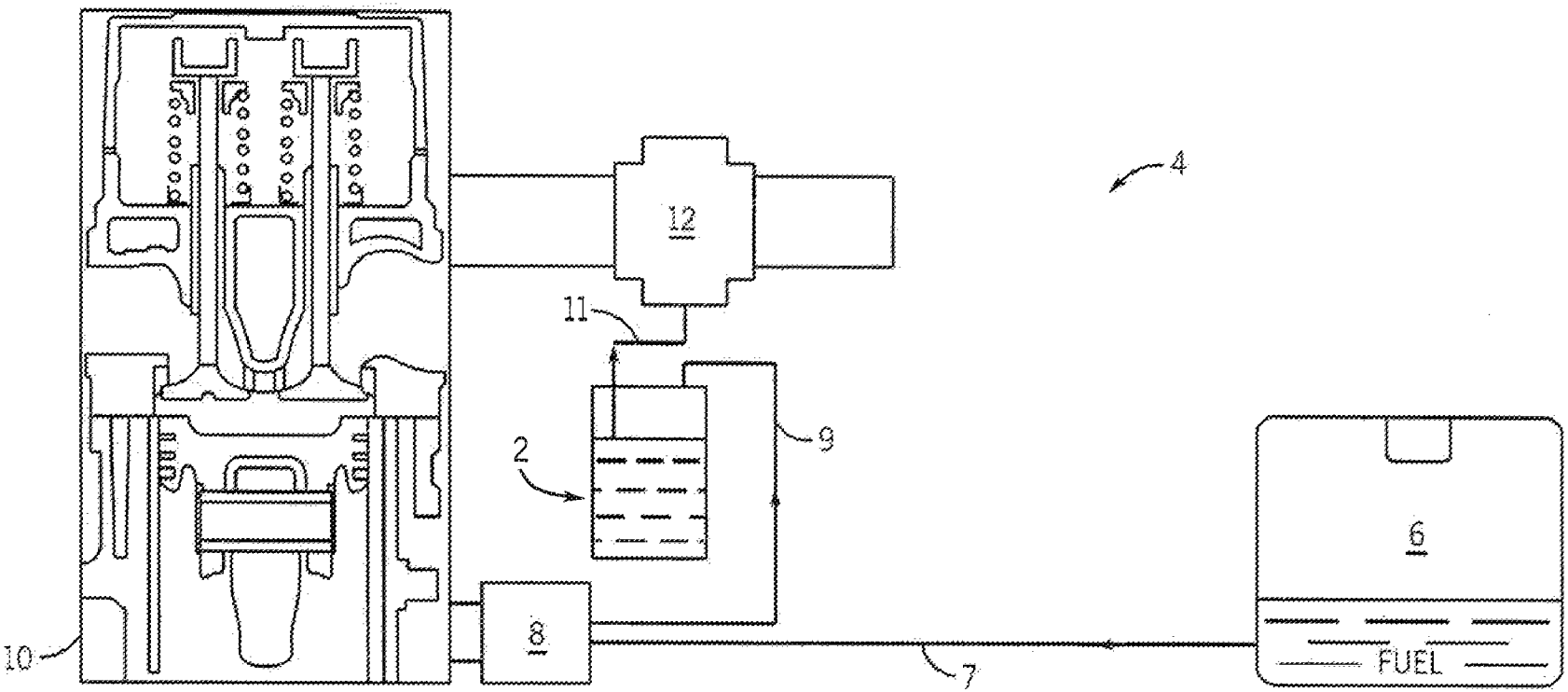
FIG. 1B is a schematic representation showing in more detail certain components of the engine mounted fuel delivery system and the engine of FIG. 1A.

Referring additionally to FIG. 1B, an additional schematic representation is provided showing both the fuel delivery system 2 and certain components of the engine 4 in conjunction with which the fuel delivery system is implemented. As shown, the fuel delivery system 2 receives low-pressure fuel from a primary fuel tank 6. More particularly, fuel is drawn out of the primary fuel tank 6 via a primary connector 7 by the pumping action of a primary fuel pump 8 located on or adjacent to the engine 4. In at least some embodiments, the primary fuel pump 8 is a low-pressure fuel pump and can take the form of, for example, a mechanical diaphragm pump or a pulse-style pump. However, in alternate embodiments, other types of fuel pumps can also be used.

Further due to the pumping action of the primary fuel pump 8, fuel is pumped away from the primary fuel pump to the fuel delivery system 2 via a secondary connector 9 linking those two structures. Thus, fuel from the primary fuel tank 6 is communicated to the fuel delivery system 2. Also as shown, the primary fuel pump 8 can be directly supported upon an engine crankcase 10. Upon reaching the fuel delivery system 2, and as described in detail below with reference to FIGS. 2-3, the fuel delivery system 2 in turn provides additional pumping action. As a result of the operation of the fuel delivery system 2, pressurized fuel exits the fuel delivery system via a pressurized connector 11 and reaches an engine intake fuel system 12. As mentioned above, the engine intake fuel system can take the form of an EFI system, although this need not be the case in every embodiment.

Figure 2:
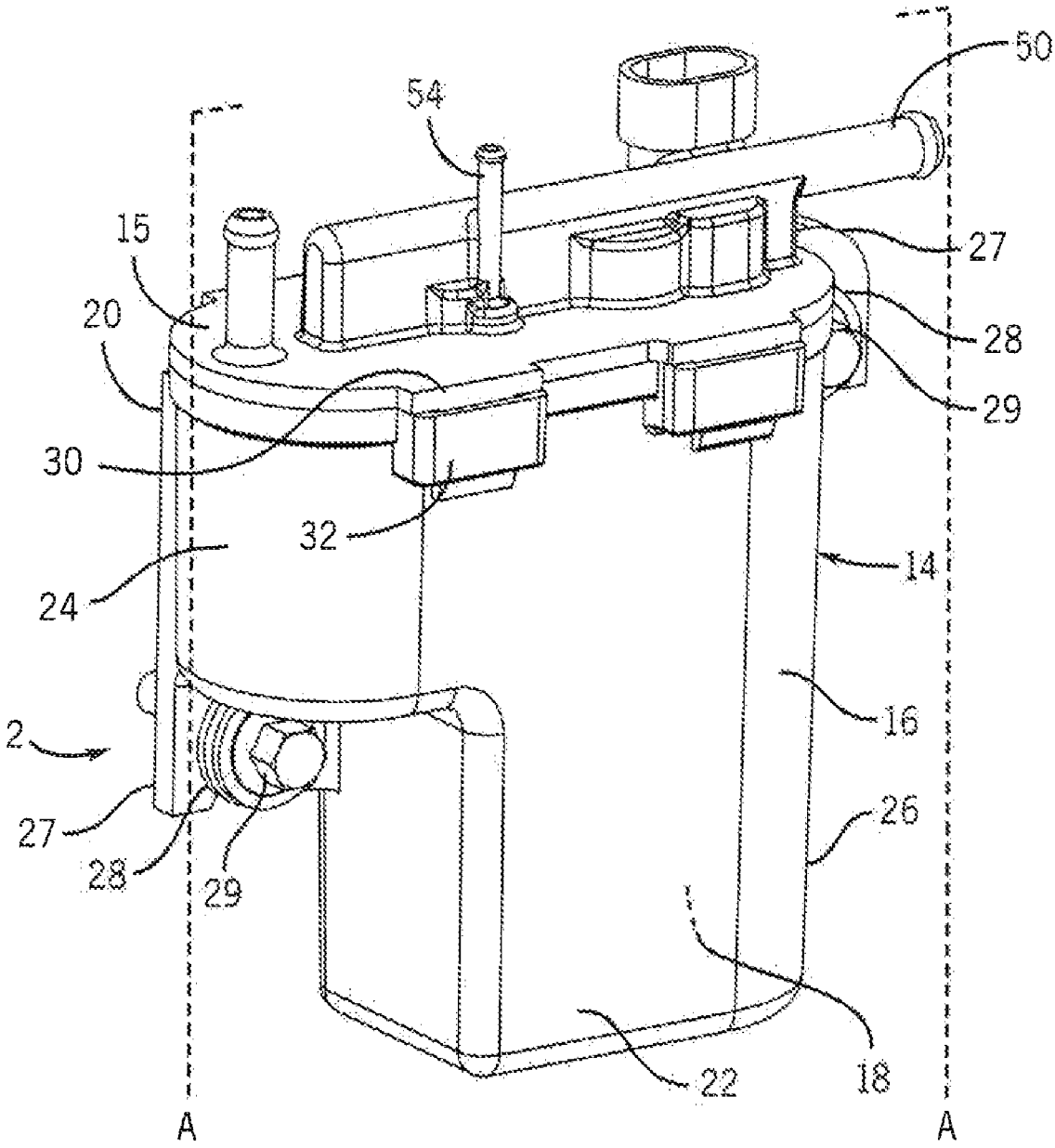
FIG. 2 is a perspective view of the engine mounted fuel delivery system of FIG. 1A.

Turning to FIG. 2, a perspective view is provided showing the fuel delivery system 2 (and particularly the exterior thereof) in more detail. As shown, the fuel delivery system 2 includes a housing 14 having a top portion 15 and a bottom portion 16. The top portion 15 and bottom portion 16 together define a reservoir chamber 18 internal to the housing 14 that is capable of receiving and storing fuel. More particularly, the top portion 15 of the housing 14 complementarily fits upon the upper end of the bottom portion 16, so as to define and enclose the reservoir chamber 18, with the top portion substantially serving as a lid for the bottom portion. In at least one embodiment, the housing 14 of the fuel delivery system 2 is made from a non-metallic, electrically insulated material, for example, plastic, carbon fiber and/or fiberglass, although it is contemplated that other materials suitable for holding fuel can be used as well.

Further as shown in FIG. 2, in the present embodiment the bottom portion 16 of the housing 14 has a mounting side 20, a profile side 22, a left end 24, and a right end 26, in addition to its bottom end (not shown). Further as shown, the mounting side 20 and profile side 22 in the present embodiment have minimal or no curvature (e.g., are substantially flat), while the left and right ends 24, 26 are curved in an outward, convex manner. Also, the widths of the mounting side 20 and profile side 22 are substantially greater in extent than the widths of the left and right ends 24, 26, such that the width of the housing 14 is substantially greater than its depth (e.g., greater than the distance between the mounting and profile sides) of the housing. Due to the dimensional characteristics of the housing 14 and flatness of the mounting and profile sides 20, 22, the fuel delivery system 2 has a substantially flat overall appearance. When mounted to the engine 4, the fuel delivery system 2 can be mounted flush to the side of the engine and does not protrude outward from the engine to an excessive extent.

Although FIG. 2 shows aspects of the exterior appearance of one embodiment of the housing 14 and the fuel delivery system 2, it should be understood that the exterior appearance can vary depending upon the embodiment from that shown. For example, although in the embodiment of FIG. 2 the left and right ends 24, 26 have a slight curvature to accommodate the internal components of the fuel delivery system (as described further with respect to FIG. 3), in alternate embodiments the left and right ends can take on different shapes. In particular, the shapes and dimensions of various aspects of the housing 14 and the fuel delivery system 2 can be modified depending upon or customized to suit a particular engine or vehicle with which the fuel delivery system is to be implemented. In some circumstances, the shape and dimensions can be varied so that the fuel delivery system 2 fits within a desired mounting space, to achieve desired air flow characteristics around the engine, or for a variety of other reasons.

Additionally as shown in FIG. 2, in the present embodiment the housing 14 includes a pair of mounting tabs 27 incorporated into the mounting side 20 of the bottom portion 16. The mounting tabs 27 allow the fuel delivery system 2 to be secured to the engine 4. More particularly, this is achieved by way of additional fastening components shown in the present embodiment to include a pair of grommets 28 and a pair of bolts 29, which extend through the mounting tabs 27. Upon being tightened with respect to the engine 4, the bolts 29 hold the mounting tabs 27 in place with respect to the engine. The grommets 28 in particular extend on both sides of each of the mounting tabs 27. When the bolts 29 are tightened with respect to the engine 4, the grommets 28 are wedged in between the mounting tabs 27 and the heads of the bolts 29 (or washers positioned adjacent to those heads), and also between the mounting tabs and the engine itself. In alternate embodiments, the fuel delivery system 2 can be secured to/mounted upon the engine 4 by way of a single mounting tab/bolt (or more than two of each), or by way of one or more other mechanisms or components including, for example, snapping mechanisms.

Also as shown in FIG. 2, in the present embodiment the top and bottom portions 15, 16 of the housing 14 are two distinct pieces that are secured together by way of two pairs of male latch portions 30 extending from the top portion 15 and two pairs of complementary female latch portions 32 formed on the bottom portion 16. FIG. 2 in particular shows one of the pairs of male latch portions 30 and one of the pairs of female latch portions 32 positioned along the profile side 22 of the bottom portion 16 of the housing 14. Although not shown, it will be understood that the others of the pairs of male and female latch portions 30, 32 are positioned along the mounting side 20 of the bottom portion 16 of the housing 14. The male and female latch portions 30, 32 are respectively configured so that the female latch portions 32 are respectively capable of receiving the respective male latch portions 30 in a snap-fit manner. In alternate embodiments, the numbers of male and female latch portions that are used can vary from two pairs of each of those latch portions (e.g., to more or less than four apiece), although there will usually be at least two male latch portions and two female latch portions, typically positioned along opposite sides of the housing 14. Additionally, in alternate embodiments, one or more other mechanisms or components can be used to fasten the top and bottom portions 15, 16 of the housing 14 to one another, or possibly those portions can even be plastic welded or otherwise fastened together to form an integral housing.

Figure 3:
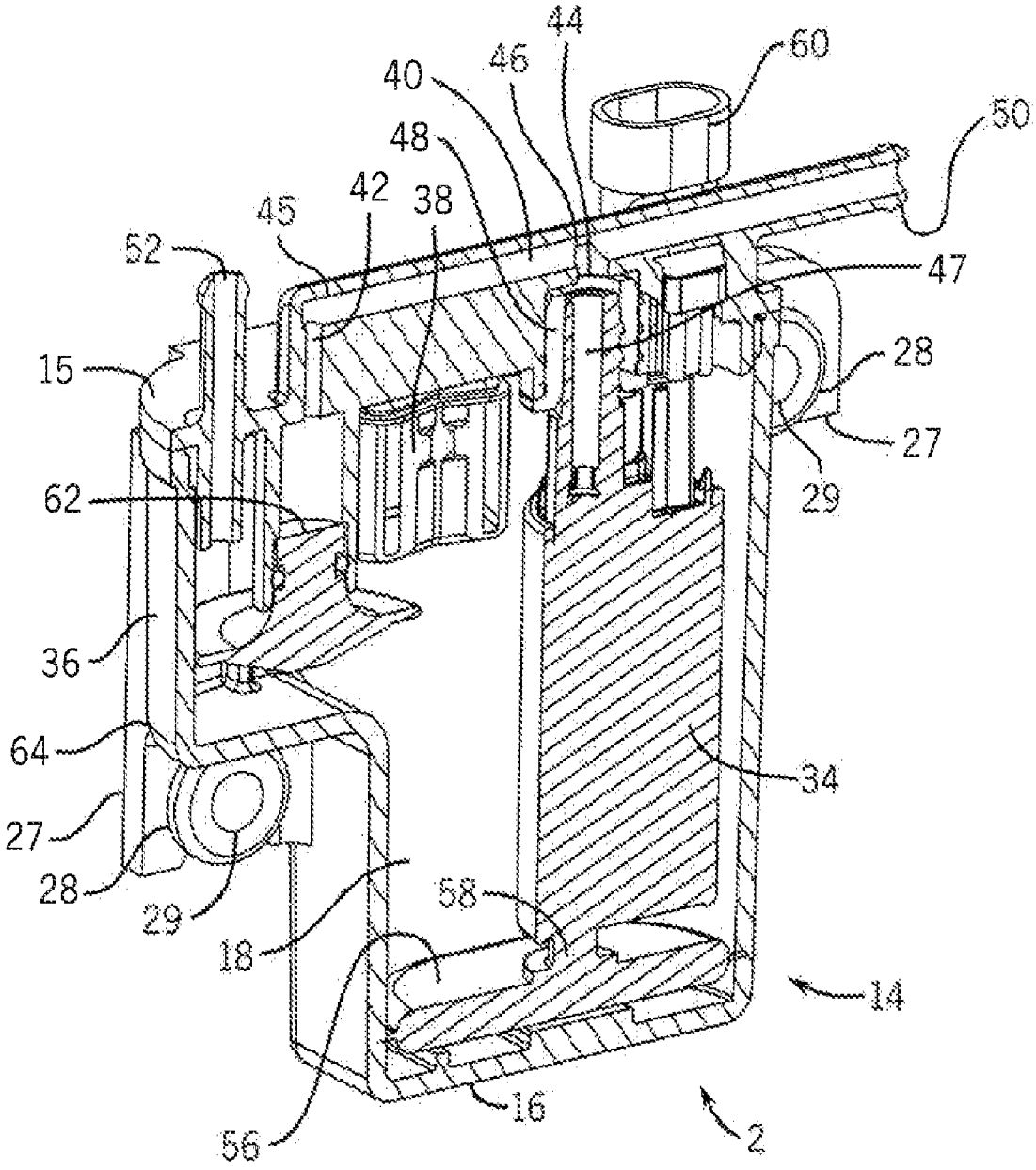
FIG. 3 is a further, cross-sectional view of the engine mounted fuel delivery system of FIGS. 1 and 2, taken along line A-A of FIG. 2.

Referring additionally to FIG. 3, a further, cross-sectional view of the fuel delivery system 2 taken along line A-A of FIG. 2 is provided to illustrate in greater detail various internal components of the fuel delivery system. As shown, the housing 14 in particular supports therewithin an additional fuel pump 34, a pressure regulator 36 and a float mechanism 38. The bottom portion 16 of the housing 14 serves to define the reservoir chamber 18 almost entirely, except insofar as the upper surface of the reservoir chamber is defined instead by the top portion 15 of the housing. The top portion 15 of the housing, in addition to enclosing the reservoir chamber 18, also has formed therewithin a supply passage 40, a regulating passage 42 and a pump passage 44, each of which is a substantially linear, tubular passage. The supply passage 40 extends in a substantially horizontal manner along nearly the entire length of the top portion 15, while each of the regulating passage 42 and pump passage 44 intersects the supply passage and extends in a substantially vertical manner downward from the supply passage. Although the supply, regulating and pump passages 40, 42 and 44 are referred to herein as separate passages, they can all generally be considered to form a single overall supply passage.

More particularly, the regulating passage 42 extends downward from a first end 45 of the supply passage 40 to the pressure regulator 36, which is positioned between the regulating passage and the reservoir chamber 18. The pump passage 44 extends downward from an intermediate location 46 along the supply passage 40 to a fuel pump outlet 47 of the fuel pump 34. The fuel pump outlet 47 is mounted so as to extend at least partially into the pump passage 44 along a pump interface segment 48 of the pump passage, so as to achieve proper sealing between the fuel pump outlet 47 and the pump passage. In at least the present embodiment, the fuel pump 34 is removably attached to the pump passage 44.

Additionally, the supply passage 40 also includes, opposite the first end 45, a discharge end 50 that extends horizontally outward away from the remainder of the top portion 15 (the intermediate location 46 being between the first and discharge ends 45, 50). The discharge end 50 serves as the fuel outlet for the fuel delivery system 2 and, as discussed above with respect to FIG. 1B, is connected to the engine fuel intake system 12 by way of the pressurized connector 11. In at least some embodiments, the engine fuel intake system 12 can be one or more fuel injectors (not shown) of an EFI system or a fuel supply rail (not shown).

Referring still to FIG. 3, the top portion 15 further includes an inlet tube 52 extending substantially vertically upward from the top portion. The inlet tube 52, which constitutes the fuel inlet for the fuel delivery system 2, forms a channel linking the reservoir chamber 18 to a location above the top portion 14. As discussed with respect to FIG. 1B, the inlet tube 52 in particular is capable of receiving fuel from the secondary connector 9, which in turn receives fuel from the primary fuel tank 6 via the primary connector 7 and the primary fuel pump 8. Upon receiving fuel from the secondary connector 9, the inlet tube 52 directs that fuel into the reservoir chamber 18, and to some extent can be said to isolate the fuel within the reservoir chamber 18 from the primary fuel tank 6 and the primary fuel pump 8.

In at least some embodiments, the secondary connector 9 (as well as possibly the primary connector 7) is a flexible rubber hose, although various other types of connectors can be used such as a rigid metal tube. Likewise, in at least some embodiments, the pressurized connector 11 is a flexible rubber hose, although various other types of connectors can be used such as a rigid metal tube. Through the use of the primary, secondary and pressurized connectors 7, 9 and 11, and particularly when those components are flexible, the fuel delivery system 2 can be mounted upon the engine 4 in a variety of positions and manners relative to the primary fuel tank 6, the primary fuel pump 8, and the engine intake fuel system 12, as well as relative to other engine and/or vehicle components.

Fuel entering the fuel delivery system 2 via the inlet tube 52 is stored in the reservoir chamber 18. The float mechanism 38, as shown in FIG. 3, is hingedly attached to the lower surface of the top portion 15 facing the reservoir chamber 18, and is positioned to open and close a vent tube 54 (shown in FIG. 2) that also extends through the top portion 15 between the reservoir chamber 18 and the external environment. The float mechanism 38 in particular is configured to react to the fuel level in the reservoir chamber 18 and effectively close the vent tube 54 when the fuel level within the reservoir chamber 18 reaches a certain threshold. Further, the float mechanism 38 substantially prevents fuel from flowing out of the reservoir chamber 18 via the vent tube 54 if the fuel delivery system 2, and/or the engine 4 on which the fuel delivery system is mounted, are overturned. Typically, the float mechanism 38 is detachable from the top portion 15.

In the present embodiment, the vent tube 54 allows fuel vapors to vent to the external environment when the float mechanism 38 is open. However, in at least some embodiments the vent tube 54 does not lead from the reservoir chamber 18 to the external environment, but rather is coupled to the engine intake system 12 (or to another location) by way of an additional connector such as another rubber hose. In such embodiments, the vent tube 54 and additional connector allow fuel vapors from the reservoir chamber 18 to be vented to the engine intake system 12 (or to another location) rather than to the external environment, thereby potentially reducing fuel vapor emissions to the environment.

Also, in other alternate embodiments, the float mechanism 38 can be employed to govern fluid flow through the inlet tube 52 rather than the vent tube 54. More particularly, in some such embodiments, the float mechanism 38 can be hingedly to the lower surface of the top portion 15 facing the reservoir chamber 18 below the inlet tube 52, and positioned so as to close the inlet tube when the fuel level within the reservoir chamber reaches a threshold level and to otherwise be open (or at least openable when fuel is directed toward the reservoir chamber through the inlet tube). In further alternate embodiments, float mechanisms can be employed both in relation to the vent tube 54 and the inlet tube 52.

Referring still to FIG. 3, the additional fuel pump 34 extends vertically between the pump passage 44 at which is located the fuel pump outlet 47, and a reservoir chamber bottom 56, at which is located a fuel pump inlet 58. In at least the present embodiment, the additional fuel pump 34 is a high-pressure fuel pump, in contrast to the primary fuel pump 8, which is a low-pressure fuel pump. The use of a high-pressure fuel pump as the additional fuel pump 34 is particularly appropriate when the fuel delivery system 2 is operating to supply pressurized fuel to an EFI system. Nevertheless, in alternate embodiments, the absolute and relative pressure levels of the fuel output by the primary and additional fuel pumps 8, 34 can take on a variety of levels. Further, in at least some embodiments, the additional fuel pump 34 is an electric turbine pump, although other types of pumps such as those employing gerotors or rolling vane components can be used in alternate embodiments.

The additional fuel pump 34 can be supplied with power in a variety of manners. In the present embodiment, the additional fuel pump 34 operates on 12 Volt Direct Current (DC) power such as that readily available from a battery on a utility engine equipped vehicle, although in other embodiments the additional fuel pump can be configured to utilize other types of power (e.g., 6 Volt DC power). Further, in the present embodiment the additional fuel pump 34 is supplied with electrical power by way of electrical leads (not shown) extending through and exiting out of an exterior surface of the top portion 15 of the housing 14. The external terminals of the electrical leads are situated in an electrical connector 60, which can take the form of a plug-type fitting allowing for convenient connection and disconnection from a power source.

To the extent that a more efficient type of pump such as an electric turbine pump is used as the additional fuel pump 34, the drain of power and current from the power source (e.g., battery) of the engine 4 can be reduced relative to what it otherwise might be (e.g., reduced by 3 amps). Further, while it is envisioned that typically the additional fuel pump 34 will be driven by way of electrical power supplied via the electrical leads, in alternate embodiments, the additional fuel pump 34 can operate using other types of power. For example, the additional fuel pump 34 can be powered by an internal electrical source (e.g., an internal battery within the fuel pump), or even possibly driven mechanically way of a rotating shaft that extends outward through the housing 14 and is driven by an external motor or other device.

Additionally as shown in FIG. 3, the pressure regulator 36 has a regulator inlet side 62 and a regulator outlet side 64. The regulator inlet side 62 is at least partially situated in the lowermost end of the regulating passage 42 opposite the end intersecting the supply passage 40, while the regulator outlet side 64 opens to the reservoir chamber 18. Given an appropriate pressure differential between the supply passage 40/regulating passage 42 and the reservoir chamber 18 across the pressure regulator 36 (typically where the pressure within the supply passage 40/regulating passage 42 exceeds that of the reservoir chamber 18 by a predetermined amount), the pressure regulator 36 allows fuel to flow in one direction, namely, from the regulating passage 42 back into the reservoir chamber 18.

Based upon the above description it is apparent that in at least some embodiments, the fuel delivery system 2 can be assembled as follows. First, the top and bottom portions 15, 16 of the housing 14 are formed, with the bottom portion largely containing the reservoir chamber 18 and the top portion including the supply passage 40, regulating passage 42 and pump passage 44. Next, the additional fuel pump 34 is coupled to the pump passage 44 and the pressure regulator 36 is coupled to the regulating passage 42. Also, the float mechanism 38 is coupled to the top portion 15. Finally, the top and bottom portions 15, 16 are assembled together to define the reservoir chamber 18, with the pressure regulator 36 and the additional fuel pump 34 extending from the supply passage 40/regulating passage 42/pump passage 44 toward and into the reservoir chamber when the top and bottom portions are so assembled.

During operation of the fuel delivery system 2, the reservoir chamber 18 is filled by way of the inlet tube 52 with fuel from the primary tank 6 via the primary connector 7, primary fuel pump 8, and secondary connector 9. Once the reservoir chamber 18 is filled to a threshold level, the float mechanism 38 closes the vent tube 54 to prevent the reservoir chamber 18 from overfilling. Additionally, assuming that the additional fuel pump 34 is operating, the additional fuel pump 34 will pump fuel up from the reservoir chamber 18 into the pump passage 44, to the supply passage 40 and the regulating passage 42, and out the discharge end 50 to the engine intake fuel system 12 via the pressurized connector 11.

Due to variations in the fuel demands of the engine 4, or due to other reasons including merely the ongoing operation of the additional fuel pump 34, the supply passage 40 (as well as the regulating and pump passages 42, 44) can experience excessive pressure due to the operation of the fuel pump 34 as it drives fuel towards the engine fuel intake system 12. When the supply passage 40 (and the regulating and pump passages 42, 44) experiences a fuel pressure level relative to that within the reservoir chamber 18 that exceeds the tolerance of the pressure regulator 36, the pressure regulator 36 allows fuel from the supply passage 40 to be returned to the reservoir chamber, thereby relieving the excessive fuel pressure within the supply passage 40. Depending upon the embodiment, the threshold tolerance of the pressure regulator 36 can take on a variety of levels, and potentially the tolerance of the pressure regulator can be varied in real time based upon operational conditions of the fuel delivery system 2 or the engine 4.

Given that the fuel delivery system 2 allows over-pressurized fuel to flow back into the reservoir chamber 18, there is no need for any additional return line to be provided between the fuel delivery system 2 (and particularly the supply passage 40/fuel pump outlet 47) and the primary fuel tank 6 in order to accommodate fuel passing through the pressure regulator 36. Nor need any additional hole be formed in the primary fuel tank 6 to accommodate such an additional return line. Further, by providing the additional fuel pump 34 and the pressure regulator 36 within the housing 14 in an integrated, modular manner, there is no need to mount multiple, separate components such as a separate pressure regulator and a separate high-pressure fuel pump upon the engine 4. Rather, only the overall fuel assembly 2 need be mounted to the engine 4.

Given the aforementioned characteristics, the fuel delivery system 2 is particularly suitable for use in conjunction with a variety of different types of engines, as well as with a variety of different types of vehicles and/or applications employing such engines, since the fuel delivery system 2 is capable of being readily implemented (or at least readily adapted for implementation) in conjunction with such various engines and/or vehicles despite different characteristic features of the engines and/or vehicles. That is, the fuel delivery system 2 is largely (if not entirely) universal in terms of its ability to be mounted on and used in conjunction with a variety of types of engines and/or vehicles.

Although applicable to a variety of different types of engines and engine applications, the fuel delivery system 2 in particular is appropriate for use in conjunction with small utility engines, which themselves are typically intended to be universally (or largely universally) applicable to a wide variety of vehicles or other applications (particularly since the manufacturers of the engines and manufacturers of the vehicles or other application components tend to be different parties). The fuel delivery system 2, given its unitary housing 14 containing each of the reservoir chamber 18, supply passage 40 (and regulating and pump passages 42, 44), pressure regulator 36, and additional fuel pump 34, has a particularly compact, integrated and modular nature that enables it to be implemented in a manner that is consistent with and does not detract from the universality of the engines themselves.

More particularly, since the fuel delivery system 2 eliminates the need for a fuel return line between the pressure regulator 36 and the primary fuel tank 6, and because there is no need to mount the various components of the fuel delivery system (e.g., the pressure regulator 36 and the additional fuel pump 34) independently of one another upon an engine or other supporting structure, the fuel delivery system 2 can be easily moved around to different support locations depending upon the requirements of the vehicle or other structure(s) with which the engine is being implemented. Also, in at least some embodiments such as that described above, the fuel delivery system 2 need not excessively protrude outward from a supporting engine on which it is mounted, which can be particularly advantageous when the engine itself is to be implemented on a vehicle or in another application where space is at a premium.

The fuel delivery system 2 also is particularly advantageous for use in conjunction with engines having EFI systems. Not only does the integrated, modular nature of the fuel delivery system 2 reduce the complexity and consequently the costs of implementing the fuel delivery system in a given engine, but also the fuel delivery system 2 also can be readily and easily added to a carburetor-equipped engine that is being modified to an EFI engine. More particularly, when modifying a carbureted engine into an EFI engine, the fuel delivery system 2 can be simply installed by mounting the fuel delivery system onto the engine as a single module, connecting the output of the original fuel pump associated with the carbureted engine to the inlet tube 52 of the fuel delivery system 2, and connecting the discharge end 50 of the fuel delivery system 2 to the EFI system.

It is specifically intended that the present invention not be limited to the embodiments and illustrations contained herein, but include modified forms of those embodiments including portions of the embodiments and combinations of elements of different embodiments as come within the scope of the following claims.

We claim:

1. An integrated, modular system for delivering fuel to an engine component, the system configured for use with an engine that is suitable for a variety of different applications and that includes a fuel tank, comprising:

a housing defining a reservoir chamber, an inlet, and an internal passage leading to an outlet, the inlet receiving fuel from the fuel tank and directing the received fuel into the reservoir chamber, the outlet capable of providing fuel from the internal passage toward the engine component, and the housing further including a top portion and bottom portion assembled together, with a vent tube extending from the reservoir chamber through the top portion of the housing;

a pump supported within the housing and having a pump input and a pump output, wherein the pump input is in fluid communication with the reservoir chamber and the pump output is in fluid communication with the internal passage;

a pressure regulator supported within the housing and having a regulator input and a regulator output, wherein the regulator input is in fluid communication with the internal passage and the regulator output is in fluid communication with the reservoir chamber; and a float mechanism hingedly attached to the top portion, wherein the float mechanism is capable of closing the vent tube when a fuel level within the reservoir chamber attains a predetermined threshold, and wherein the float mechanism substantially prevents fuel from flowing out of the reservoir chamber via the vent tube if the modular system is overturned;

whereby the integrated, modular system is capable of being implemented upon the engine by mounting the housing upon the engine, establishing a first connection between the inlet and the fuel tank, and establishing a second connection between the outlet and the engine component, and wherein the modular system is configured for use in a land vehicle.

2. The system of claim 1, wherein the pump is configured to supply pressurized fuel to the passage that is suitable for use by an Electronic Fuel Injection (EFI) system of the engine, the EFI system being the engine component.

3. The system of claim 1, wherein the pump is a turbine pump.

4. The system of claim 1, wherein the passage is formed entirely within the top portion, and wherein an upper surface of the reservoir chamber is formed by the top portion.

5. The system of claim 1, wherein the passage includes a supply passage portion, a pump passage portion leading between the supply passage portion and the pump, and a regulating passage portion leading between the supply passage portion and the pressure regulator.

6. The system of claim 1, further comprising a plurality of electrical leads extending from the pump through the top portion to an external plug feature formed on the top portion.

7. The system of claim 1, wherein the pressure regulator allows fuel to flow back from the passage to the reservoir chamber when a fuel pressure within the passage exceeds a predetermined threshold, the fuel not being directed back to the fuel tank; and wherein the housing has a thickness and a width, the thickness being substantially less than the width so that the housing does not protrude substantially outward from a side of the engine when mounted thereto;

whereby the system is thereby configured to facilitate positioning of the system at any of a plurality of locations relative to the engine so as to accommodate at least one of an engine characteristic and another characteristic of at least one of a vehicle and another application with which the engine is to be utilized.

8. An internal combustion engine suitable for use in conjunction with a plurality of applications, the internal combustion engine comprising:

an Electronic Fuel Injection (EFI) engine intake system;

a fuel tank;

a first pump coupled to receive fuel from the fuel tank;

an integrated, modular fuel delivery system having a housing defining both a reservoir chamber and a supply passage therewithin, a second pump contained within the housing and coupled between the reservoir chamber and the supply passage, and a pressure regulator also contained within the housing and coupled between the reservoir chamber and the supply passage, wherein the modular fuel delivery system is configured for use in a land vehicle;

first and second connectors respectively linking the first pump to an inlet of the reservoir chamber and linking an outlet of the supply passage to the EFI engine intake system, the inlet allowing for a first flow of the fuel from the first connector into the reservoir chamber, the outlet allowing for a second flow of pressurized fuel output by the second pump into the second connector;

a means for allowing fuel vapors to exit the reservoir chamber, wherein the means includes a vent tube extending from a top portion of the reservoir chamber and a float mechanism capable of closing the vent tube the float mechanism substantially preventing fuel from flowing out of the reservoir chamber via the vent tube if the engine is overturned; and a means for limiting filling of the reservoir chamber, and wherein the means for limiting filling also serves to restrict fuel egress when the fuel delivery system is orientated in an inverted manner.

9. The internal combustion engine of claim 8, wherein the first and second connectors are each flexible connectors such that the integrated, modular fuel delivery system can be mounted at a variety of different positions in relation to the engine.

10. The internal combustion engine of claim 8, wherein the housing of the fuel delivery system includes a top portion and a bottom portion, wherein the bottom portion substantially defines the reservoir chamber except insofar as the top portion forms a lid over the reservoir chamber, and wherein the supply passage is formed internally within the top portion.

11. The internal combustion engine of claim 8, further comprising means for fastening the fuel delivery system onto the engine.

12. The internal combustion engine of claim 8, wherein the pressure regulator allows for a third flow of at least a portion of the pressurized fuel output by the second pump to occur from the supply passage back into the reservoir chamber.

13. The internal combustion engine of claim 8, wherein the fuel delivery system is formed by providing a bottom portion of the housing and a top portion of the housing that includes the supply passage, coupling the pump mechanism to a pump passage portion of the supply passage, coupling the pressure regulator to a regulating passage portion of the supply passage, and assembling the top portion and bottom portion together to define the reservoir chamber, the pressure regulator and the pump mechanism extending from the supply passage toward the reservoir chamber when the top and bottom portions are so assembled.

14. A method of providing pressurized fuel to an engine component, the method for use with an engine that is suitable for a variety of different applications and that includes a primary fuel tank, the method comprising:

providing a housing defining a reservoir chamber and a supply passage having a discharge end, wherein an inlet tube for receiving fuel from the primary fuel tank extends through the housing and to the reservoir chamber, wherein the housing includes a top portion and a bottom portion, and wherein the top portion serves as a lid over a cavity within the bottom portion to thereby form the reservoir chamber;

providing a pump mechanism and a pressure regulator supported within the housing, wherein each of the pump mechanism and the pressure regulator is interconnected between the supply passage and the reservoir chamber;

pumping at least some of the fuel from the reservoir chamber to the supply passage by way of the pump mechanism;

regulating a pressure within the supply passage by way of the pressure regulator, which allows for at least some of the fuel pumped into the supply passage to pass back into the reservoir chamber when the pressure exceeds a threshold level;

discharging at least some of the fuel from the discharge end at least indirectly to the engine component;

venting fuel vapors from the reservoir chamber to a location external of the housing via a vent tube extending through the housing; and closing the vent tube when the fuel level within the reservoir chamber reaches a predetermined level via a float mechanism supported within the housing, the float mechanism substantially preventing fuel from flowing out of the reservoir chamber via the vent tube if the engine is overturned:

wherein the engine is configured for use in a land vehicle.

15. The method of claim 14, wherein the pump mechanism is a turbine fuel pump.

16. The method of claim 14, wherein the supply passage is formed within the top portion, wherein an end of the pressure regulator is inserted into a regulating passage portion of the supply passage, wherein an end of the pump mechanism is inserted into a pump passage portion of the supply passage, the pressure regulator and pump mechanism each extending away from the supply passage toward and into the reservoir chamber.

17. A method of converting an internal combustion engine from a first status in which the internal combustion engine is a carbureted engine to a second status in which the internal combustion engine employs an Electronic Fuel Injection (EFI) system, the method comprising:

adding the EFI system to the internal combustion engine configured for use with a land vehicle;

providing a fuel delivery system module having a housing that defines a reservoir chamber and a supply passage and that supports therewith in both a pump mechanism and a pressure regulator, the pump mechanism and the pressure regulator both linking the supply passage with the reservoir chamber;

connecting a primary fuel tank to an inlet of the fuel delivery system, the inlet leading to the reservoir chamber;

connecting an outlet of the supply passage to the EFI system;

connecting at least one electrical power lead to a terminal on the housing so that electrical power can be supplied to the pump mechanism; and connecting a further tube between a vent passage on the housing and another portion of the engine, the vent passage leading to the reservoir chamber;

wherein flow through the tube is controlled by a float mechanism hingedly attached to the reservoir chamber, and the float mechanism substantially prevents fuel from flowing out of the reservoir chamber via the tube if the engine is overturned.

* * * * *